US006958456B1

(12) United States Patent
Jur et al.

(10) Patent No.: US 6,958,456 B1
(45) Date of Patent: Oct. 25, 2005

(54) POSITIVE LOCKING, TRIGGER GRIP, EXTERNAL OPERATING HANDLE ASSEMBLY FOR NETWORK PROTECTOR ENCLOSURES

(75) Inventors: Arthur James Jur, Greenwood, SC (US); Kevin Michael Davis, Greenwood, SC (US); Douglas Michael Brandt, Greenwood, SC (US); Mark Andre Faulkner, Greenwood, SC (US); Derek A. Harrison, Greenwood, SC (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/925,794

(22) Filed: Aug. 25, 2004

(51) Int. Cl.[7] ..... H01H 9/20

(52) U.S. Cl. ..... 200/50.01; 200/43.16; 200/50.28; 361/605; 361/610

(58) Field of Search ..... 200/50.01–50.19, 200/50.26–50.33, 50.37, 43.01, 43.11, 43.16; 361/605, 608–610, 615

(56) References Cited

U.S. PATENT DOCUMENTS 4,012,610 A * 3/1977 Ericson et al. ..... 200/50.26
4,154,993 A * 5/1979 Kumbera et al. ..... 200/50.24
5,164,883 A * 11/1992 Little et al. ..... 361/609
5,278,722 A * 1/1994 Peruso ..... 361/606
5,448,027 A * 9/1995 Hoffman et al. ..... 200/50.31
6,005,208 A * 12/1999 Castonguay ..... 200/308
6,207,909 B1 * 3/2001 Tallman et al. ..... 200/50.02
6,388,868 B1 * 5/2002 Leccia et al. ..... 361/607
6,486,421 B1 * 11/2002 Jones et al. ..... 200/50.32
6,590,756 B2 7/2003 Meiners et al.

* cited by examiner

*Primary Examiner*—Richard K. Lee
(74) *Attorney, Agent, or Firm*—Martin J. Moran

(57) ABSTRACT

A handle assembly for a network protector where the network protector includes a circuit breaker and a housing assembly, the circuit breaker having a trip bar structured to move between a first position and a second position corresponding to an open and closed position of the circuit breaker, respectively, the housing assembly having a sidewall with an opening. The handle assembly includes a linkage assembly, a shaft assembly, a handle member and locking assembly. The shaft assembly has a shaft, where the shaft rotatably is disposed in the opening and structured to move between a first and second position. The handle member has an elongated body and an elongated grip extending generally perpendicular to the handle body. The handle body is coupled to, and structured to rotate, the shaft. The locking assembly has an elongated release grip. The locking assembly is coupled to the handle member and structured to selectively lock the shaft in at least the first position, and the release grip is structured to unlock the locking assembly. The release grip extends generally adjacent and parallel to the handle grip. The linkage assembly is coupled to the shaft and structured to engage the trip bar so that when the shaft is in the first position, the trip bar is in the first position and when the shaft is in the second position, the trip bar is in the second position.

12 Claims, 3 Drawing Sheets

POSITIVE LOCKING, TRIGGER GRIP, EXTERNAL OPERATING HANDLE ASSEMBLY FOR NETWORK PROTECTOR ENCLOSURES

BACKGROUND OF THE INVENTION

1. Field of the Invention

The present invention relates to network protectors and, more specifically, to an external operating handle that may be used by an operator wearing thick gloves.

2. Background Information

Secondary power distribution networks consist of interlaced grids which are supplied by two or more sources of power so that the loss of a single source of power will not result in an interruption of service. Such networks provide the highest level of reliability possible with conventional power distribution and are normally used to supply high-density load areas such as a section of a city, a large building, or an industrial site. Between the power sources and the network is a transformer and a network protector. The network protector consists of a circuit breaker and a control relay. The circuit breaker includes at least one set of main contacts that move between an open position and a closed position. When the main contacts are closed, electricity may flow through the network protector. The contacts are coupled to an operating mechanism structured to move the contacts between the first and second positions. The operating mechanism may be actuated by a trip device structured to sense an over-current condition or by a mechanical trip assembly that is manually operated. The control relay senses the transformer and network voltages and line currents and executes algorithms to initiate breaker tripping or closing action. Trip determination is based on detecting an overcurrent condition or reverse power flow, that is, power flow from the network to the energy source.

Network protectors are often found in dust-proof or moisture-proof housings, or vaults, which are disposed in subterranean passageways in large metropolitan areas. Given their urban, subterranean location, increasing the size of the vault to accommodate larger network protectors is costly and difficult. As such, it is more efficient to reduce the space occupied by certain network protector components so as to allow space for other newer/larger components. That is, by reducing the size of one component or sub-component, another component may be added or an existing component's size may be increased.

The network protector components, the circuit breaker, the relay and other associated devices, are located within a housing assembly within the vault. For safety, the circuit breaker should be tripped before the circuit breaker can be removed from the enclosure. To accomplish this, network protectors include a mechanical trip assembly which is structured to interact with a trip bar coupled to the operating mechanism. The trip bar is structured to move between a first position and a second position. In the first position, the trip bar prevents the main contacts of the network protector circuit breaker from moving into the closed position. Thus, when the trip bar is in the first position, the contacts are open. In the second position, the trip bar allows the main contacts to be moved into the closed position. The trip bar could also be moved into a reset position corresponding to a reset position for the circuit breaker.

To safely remove, or install, the circuit breaker from the enclosure, the main contacts must be in the first, open position. To trip the circuit breaker, the trip bar was moved into the first position by the mechanical trip assembly. The mechanical trip assembly included an external handle coupled to a shaft that extended from outside the housing assembly to within the housing assembly and a coupling device that extended between the shaft and the trip bar. Typically, the shaft extended laterally within the network protector housing and extended beyond either the left or right housing sidewall. The handle was coupled to the shaft and extended radially, that is, perpendicular to the axis of the shaft. As such the handle extended generally parallel to the plane of the housing sidewall. If there was sufficient space within the vault, the handle may also have a perpendicular rod, or grip, extending laterally. When the shaft was rotated, the coupling device moved thereby actuating the trip bar. A typical mechanical trip assembly is structured to be actuated prior to opening the door to the enclosure.

Accordingly, the mechanical trip device included an external handle that could be actuated prior to opening the door to the housing assembly. Actuating the external operating handle moved the mechanical trip assembly, and therefore the trip bar, into the first position. Thus, before the housing assembly is opened, the circuit breaker was tripped. If required, however, it was possible to open the housing assembly with the trip bar in the second position, leaving the circuit breaker in the closed position. After maintenance and/or repairs are performed on the circuit breaker or the relay, and after the circuit breaker is installed in the vault, the mechanical trip assembly, and therefore the trip bar, is moved, if required, into the reset position, and then into the second position so that the main contacts could again be closed.

To prevent the accidental actuation of the external handle, the typical handle included a locking device. The locking device included a guide plate fixed to the outer side of, and extending generally parallel to, the housing assembly sidewall, and a pin. The guide plate and the handle are disposed adjacent to each other and included openings sized to allow the pin to pass therethrough. The openings on the guide plate were positioned to align with the handle opening when the handle was in either the first or second position. Thus, the handle, and therefore the mechanical trip assembly, could be locked in either the first or second position by inserting the pin through the handle and into the guide plate. The locking pin was actuated, for example, by a push lever. That is a lever actuated by a user was structured to move the pin between the locked and unlocked positions.

The disadvantage to the prior art handle locking devices is that the actuating means for locking and unlocking the handle were relatively small. That is, formerly, users were not required to utilize safety gloves, or the gloves that were required were not as bulky, and other protective measures when actuating the handle. Thus, the release mechanism for the handle assembly was sized for an ungloved hand. Today, users utilize thicker protective clothing that makes gripping the former type of release device difficult. Additionally, the prior art locking devices were often difficult to access due to the confined nature of the vault. These confined spaces are prone to cause damage to the newer, thicker protective clothing as a user may catch and tear the clothing.

There is, therefore, a need for an external handle that is easy to grip by a user wearing thick gloves.

There is a further need for a handle locking device that is easy to access by a user wearing thick gloves.

SUMMARY OF THE INVENTION

These needs, and others, are met by the present invention which provides an external handle having a lateral grip and a locking device having a release grip extending generally parallel and adjacent to the lateral grip. A user may easily grasp the two adjacent grips with one hand. When the user squeezes the two grips together, the locking device is released and the handle may be moved between the first and second positions. Preferably, the locking device uses a pin that is structured to engage openings in a guide plate. Movement of the pin is controlled by the release grip. For example, the pin may be disposed on one side of a pivoting lever member. The lever member is pivotally mounted in the handle. The release grip is coupled to the lever member on the side opposite the pin. Thus, when the release grip is moved toward the handle grip, the lever arm is rotated about the pivot thereby moving the pin out of engagement with the guide plate. A spring may be used to bias the pin into the guide plate.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
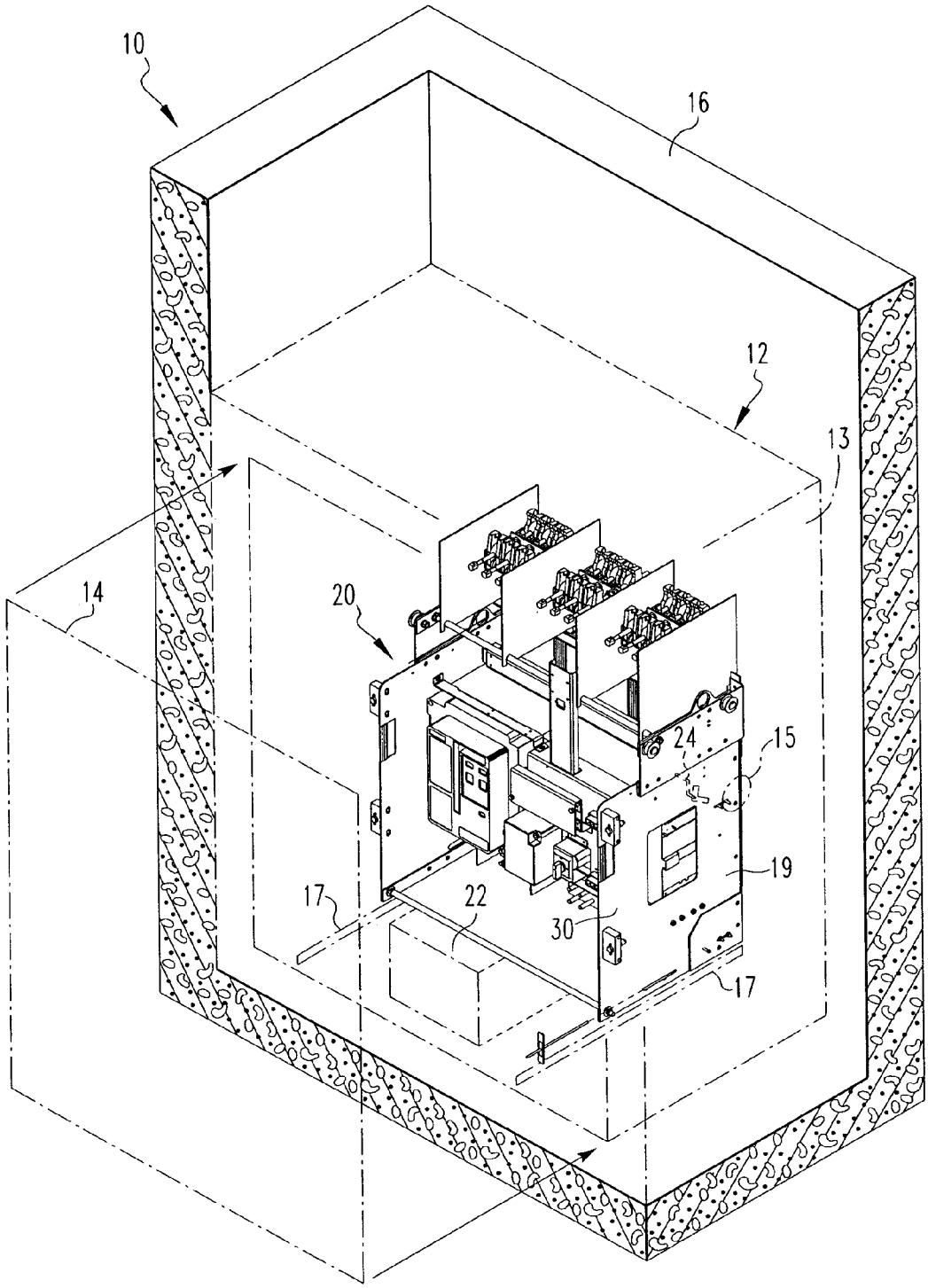
FIG. 1 is an isometric view of a network protector in a vault.

As shown in FIG. 1, a network protector 10 includes a housing assembly 12 which includes a movable door 14 that is attached to the housing assembly 12. The housing assembly 12 has at least one lateral sidewall 13 having an opening 15 for an external handle assembly 34 (described below) to pass therethrough. The handle assembly 34 interacts with the trip bar 24 (described below) and may be actuated while the door 14 is closed. The housing assembly 12 is structured to be placed within a vault 16. The vault 16 is typically made of concrete or a similar material. The two primary network protector components, a circuit breaker 20 and a relay 22 are disposed within the housing assembly 12. The circuit breaker 20 is supported by a rollout carriage 19. The housing assembly 12 includes a set of rails 17 (shown schematically) upon which the rollout carriage 19 rests so that the circuit breaker 20 may be moved into and out of the housing assembly 12.

As is known in the art, the circuit breaker 20 includes at least one set of main contacts (not shown) that are structured to move between a first, open position and a second closed position. When the main contacts are in the second, closed position, electricity may flow through the circuit breaker 20. When the main contacts are in the first, open position, electricity cannot flow through the circuit breaker 20. The circuit breaker 20 also includes an operating mechanism (not shown) that is structured to move the main contacts between the first and second position. The operating mechanism is coupled to the trip device (not shown) that is structured to trip the circuit breaker 20 upon a predetermined condition, such as an over-current event, and a trip bar 24. The trip bar 24 is operatively coupled to the mechanical trip assembly 30 (described below) and is part of the mechanism for manually tripping the circuit breaker 20. The trip bar 24 is structured to move between a first position and a second position. When the circuit breaker 20 is in use, both the main contacts and the trip bar 24 are in the second position. When the trip bar 24 moves from the second position to the first position, the operating mechanism will trip the circuit breaker 20. That is, the operating mechanism will cause the main contacts to move from the second position to the first position. So long as the trip bar 24 remains in the first position, the main contacts cannot be fixed in the second position. That is, so long as the trip bar 24 is in the first position, the circuit breaker 20 cannot be set in the closed position.

The circuit breaker 20 further includes a mechanical trip assembly 30. As shown in FIGS. 2–5, the mechanical trip assembly 30 is structured to engage the trip bar 24 so that the circuit breaker 20 may be tripped manually. The mechanical trip assembly 30 includes a linkage assembly 32 and a handle assembly 34. As shown in FIG. 3, the linkage assembly 32 includes a mechanical link 33 structured to directly engage the trip bar 24. However, it is understood that the linkage assembly 32 may be any type of linkage device, such as, but not limited to, mechanical linkage assembly or a cable linkage. See e.g. U.S. Pat. No. 6,590,756. The linkage assembly 32 is coupled to the handle assembly shaft 42, described below, and is structured to translate rotation of the shaft 42 into movement of the trip bar 24.

Figure 3:
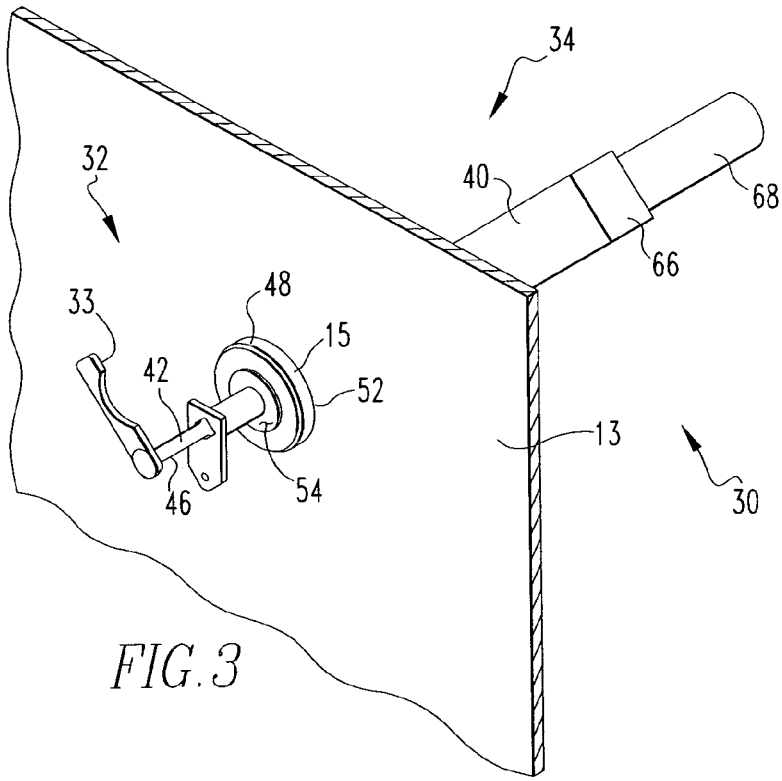
FIG. 3 is an isometric view of the shaft coupled to the handle assembly of the present invention.
Figure 4:
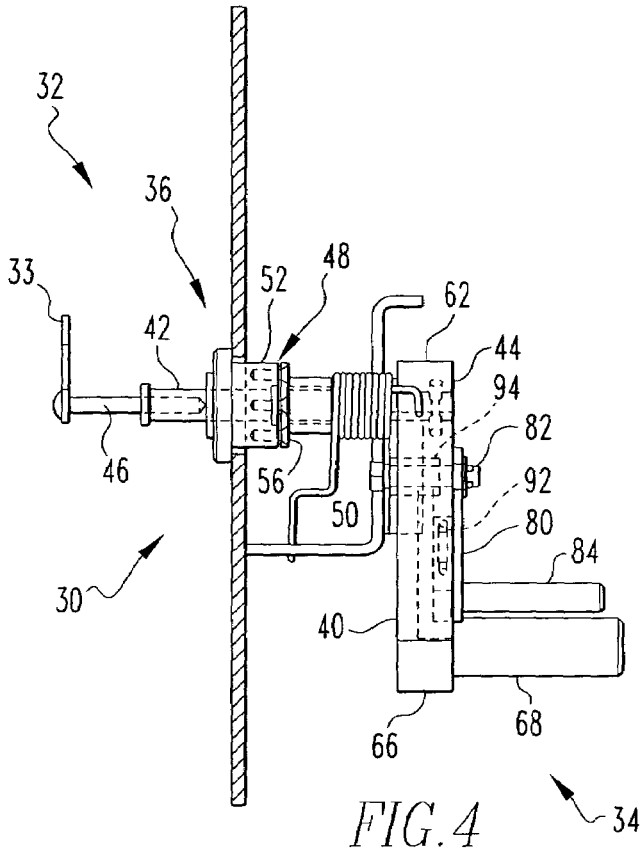
FIG. 4 is a top view of the handle assembly of the present invention.

The handle assembly 34 includes a shaft assembly 36, a locking assembly 38, and a handle member 40. The shaft assembly 36 includes an elongated shaft 42, having a first end 44 and a second end 46, a collar assembly 48, and a return spring 50. The shaft 42 is structured to extend through the opening 15. The collar assembly 48 includes a torus-shaped body 52 having a central opening 54 (FIG. 3), which is generally the same diameter as the shaft 42, and at least one O-ring seal 56 (FIG. 4). The collar body 52 is attached to the opening 15. The shaft 42 extends through the collar body 52 so that the shaft first end 44 is disposed outside the housing assembly 12 and the second end 46 is disposed within the housing assembly 12. The shaft 42 is structured to rotate between at least two positions, a first position and a second position. When the shaft 42 is moved into, or maintained in, the first position, the linkage assembly 32 moves, or maintains, the trip bar 24 in the first position. Thus, if the circuit breaker 20 is closed, rotation of the shaft 42 into the first position will trip the circuit breaker 20. When the shaft 42 is moved into, or maintained in, the second position, the linkage assembly 32 moves the trip bar 24 into the second position so that the circuit breaker 20 may be closed by the operating mechanism. The return spring 50 is disposed about, and coupled to, the shaft 42 and is structured to bias the shaft 42 to the first position.

The handle member 40 is coupled to the shaft first end 44. The handle member 40 includes an elongated body 60 having a first end 62, a medial portion 64, and a second end 66. The handle first end 62 is fixed to the shaft first end 44 so that rotation of the handle member 40 results in a rotation of the shaft 42. The handle member body 60 extends generally radially from the shaft 42 and generally parallel to the housing sidewall 13. The handle member body 60, preferably, has an elongated cavity 67 disposed in the medial portion 64. An elongated handle grip 68 extends generally perpendicular to the handle member body 60 from the handle member body second end 66 and away from the housing assembly sidewall 13. Thus, the handle grip 68 extends generally parallel to the shaft 42. The handle grip 68 has a sufficient length so that it may be easily grasped by a gloved hand. Preferably, the length of the handle grip 68 is between about two and five inches, and more preferably about three inches.

Figure 2:
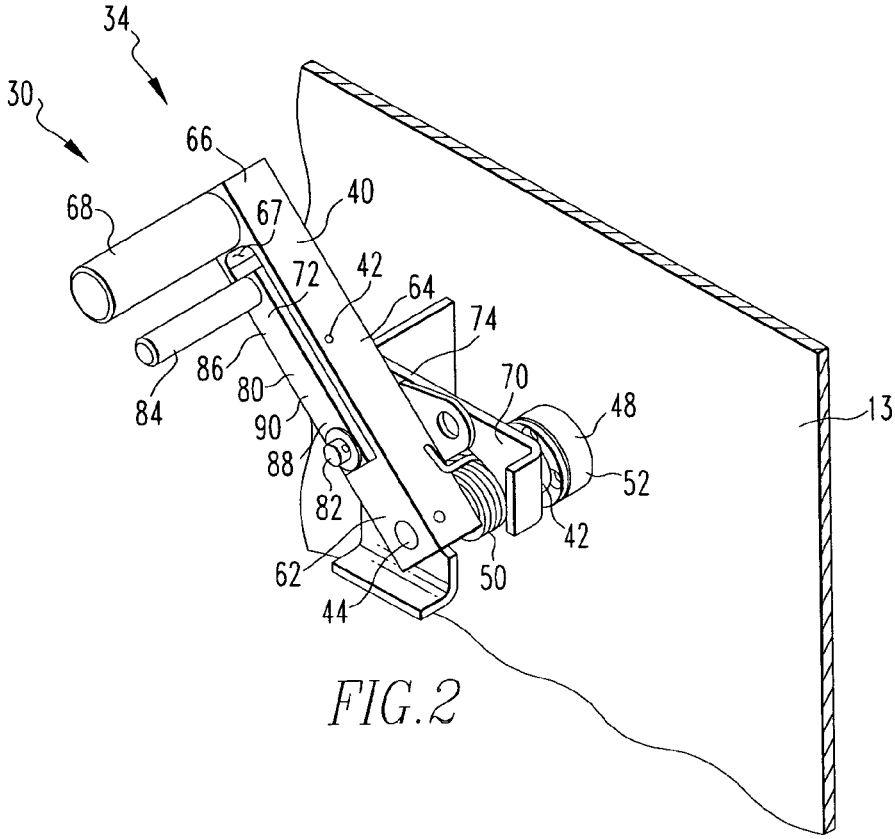
FIG. 2 is an isometric view of the handle assembly of the present invention.
Figure 5:
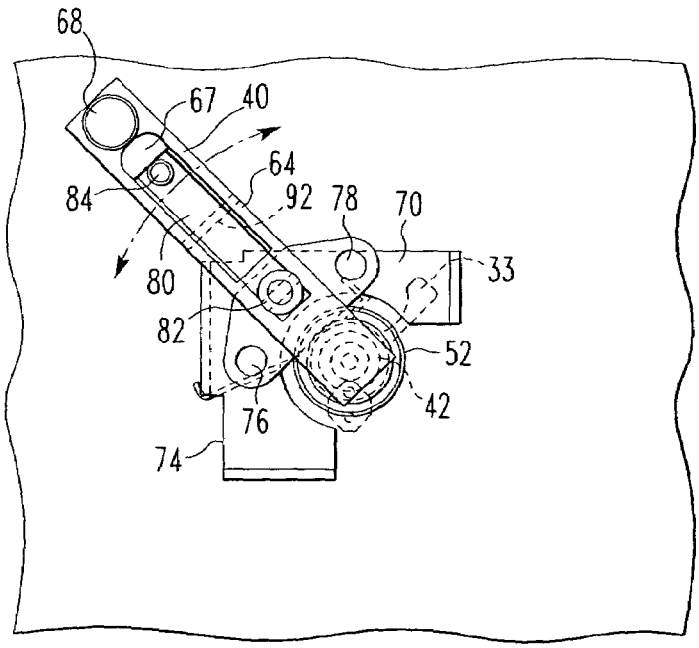
FIG. 5 is a side view of the handle assembly of the present invention.

As shown in FIG. 2, the locking assembly 38 includes a guide plate 70 and a lever member assembly 72. As shown in FIG. 5, the guide plate 70 is a generally flat body 74 having has at least one, and preferably two, opening(s), a first position opening 76 and a second position opening 78. As shown in FIG. 2, the guide plate body 74 is coupled to the outer side of the housing assembly sidewall 13 adjacent to the sidewall opening 15. The guide plate body 74 extends generally parallel to the sidewall 13 and is disposed between the handle member 40 and the housing assembly sidewall 13. The lever member assembly 72 includes an elongated lever member 80, a locking pin 82 and an elongated release grip 84. Preferably, the length of the release grip 84 is between about two and four inches, and more preferably about two-and-a half inches. The elongated lever member 80 includes a first end 86, a second end 88 and a medial portion 90. A medial pivot pin 92 extends laterally through the lever member medial portion 90. The locking pin 82 extends from the lever member first end 86 in a direction generally perpendicular to the medial pivot pin 92. The release grip 84 extends from the lever member second end 88 in a direction generally perpendicular to the medial pivot pin 92 and in the opposite direction from the locking pin 82.

The locking assembly 38 is assembled as follows. The guide plate body 74 is coupled to the outer side of the housing assembly sidewall 13 adjacent to the sidewall opening 15. The guide plate body 74 extends generally parallel to the sidewall 13 and is disposed between the handle member 40 and the housing assembly sidewall 13. The lever member assembly 72 is coupled to the handle member 40 with the lever member 80 pivotally disposed in the handle member cavity 67. The lever member 80 is coupled to the handle member body 60 by the pivot medial pin 92. The locking pin 82 extends from the lever member first end 86 towards the guide plate 70. The release grip 84 extends from the lever member second end 88 adjacent to the handle grip 68. The lever member assembly 72 may further include a pin spring 94 structured to bias the pin 92 toward the guide plate 70.

The guide plate 70 first position opening 76 and second position opening 78 are located on the guide plate 70 such that when the shaft 42 is in the first position, the handle member 40 is disposed over the first position opening 76, and when the shaft 42 is in the second position, the handle member 40 is disposed over the second position opening 78. The guide plate openings 76, 78 are further positioned to be engaged by the locking pin 82. Thus, when the shaft 42 is in the first position, the pin spring 94 biases the locking pin 82 to engage the first position opening 76 and when the shaft 42 is in the second position, the pin spring 94 biases the locking pin 82 to engage the second position opening 78.

The locking assembly 38 operates as follows. When the network protector 10 is being operated under normal conditions, the housing assembly door 14 is closed and the circuit breaker 20 contacts are closed. Moreover, the trip bar 24 and the shaft 42 are in the second position and the locking pin 82 is engaged in the second position opening 78. When the housing assembly 12 needs to be opened, i.e., for maintenance, an operator typically must trip the circuit breaker 20. To trip the circuit breaker 20, the operator, who is typically wearing thick safety gloves, unlocks the locking assembly 38 by grasping the elongated handle grip 68 and the adjacent elongated release grip 84. By squeezing the handle grip 68 and the release grip 84 together the release grip 84 causes the lever member 80 to rotate on the pivot pin 92 so that the locking pin 82 is moved out of engagement with the second position opening 78. At this point, the operator uses the handle member 40 to rotate the shaft 42 into the first position. As the shaft 42 moves into the first position, the linkage assembly 32 moves the trip bar 24 into the first position causing the circuit breaker 20 to trip. The operator may release pressure on the release grip 84 allowing the pin spring 94 to bias the locking pin 82 into the first position opening 76. If the handle member 40 is not properly aligned with the second position opening 78, the locking pin 82 will contact the guide plate 70 and the operator may be required to adjust the handle member 40 position until the locking pin 82 engages the first position opening 76. Thus, the handle assembly 34 is locked in the first position and the circuit breaker 20 may not be maintained in the second, closed position.

To close the circuit breaker 20, the operator again grasps the elongated handle grip 68 and the adjacent elongated release grip 84. When the operator squeezes the handle grip 68 and the release grip 84 together, the movement of the release grip 84 causes the lever member 80 to rotate on the pivot pin 92 so that the locking pin 82 is moved out of engagement with the first position opening 76. Thus, the operator is free to return the handle member 40 to a position over the second position opening 78 so that the shaft 42 and the trip bar 24 are in the second position. When the operator releases pressure on the release grip 84, the pin spring 94 biases the locking pin 82 into the second position opening 78. If the handle member 40 is not properly aligned with the second position opening 78, the locking pin 82 will contact the guide plate 70 and the operator may be required to adjust the handle member 40 position until the locking pin 82 engages the second position opening 78. The operator may then close the circuit breaker 20.

While specific embodiments of the invention have been described in detail, it will be appreciated by those skilled in the art that various modifications and alternatives to those details could be developed in light of the overall teachings of the disclosure. For example, the locking assembly 38 may be structured with only the first position opening 76 so that the shaft 42 cannot be locked in the second position. Accordingly, the particular arrangements disclosed are meant to be illustrative only and not limiting as to the scope of invention which is to be given the full breadth of the claims appended and any and all equivalents thereof.

What is claimed is:

1. A handle assembly for a network protector, said network protector including a circuit breaker and a housing assembly, said circuit breaker having a trip bar structured to move between a first position and a second position corresponding to an open and closed position of said circuit breaker, respectively, said housing assembly having a sidewall with an opening, said handle assembly comprising:

a shaft assembly, said shaft assembly having a shaft, said shaft rotatably disposed in said opening and structured to move between a first and second position;

a handle member having an elongated body and an elongated grip extending generally perpendicular to said handle body, said handle body coupled to, and structured to rotate, said shaft;

a locking assembly having an elongated release grip, said locking assembly coupled to said handle member and structured to selectively lock said shaft in at least said first position, and said release grip structured to unlock said locking assembly;

said release grip extending generally adjacent and parallel to said handle grip; and a linkage assembly coupled to said shaft and structured to engage said trip bar so that when said shaft is in said first position, said trip bar is in said first position and when said shaft is in said second position, said trip bar is in said second position.

2. The handle assembly for a network protector of claim 1, wherein:

said handle grip has a length between about 2 and 5 inches; and said release grip has a length between about 2 and 4 inches.

3. The handle assembly for a network protector of claim 2, wherein:

said handle grip has a length of about 3 inches; and said release grip has a length of about 2.5 inches.

4. The handle assembly for a network protector of claim 1, wherein said locking assembly is further structured to lock said shaft in said second position.

5. The handle assembly for a network protector of claim 1, wherein said locking assembly includes a lever member assembly and a guide plate;

said lever member assembly having an elongated lever member with a pivot pin, a locking pin, a spring and further including said release grip;

said handle member body having an elongated cavity therein;

said lever member disposed in said cavity and coupled to said handle member;

said guide plate having at least one opening and said guide plate coupled to, and extending generally parallel to, said housing assembly sidewall;

said locking pin coupled to, and extending generally perpendicular to, said lever member, said locking pin extending toward said guide plate;

said spring structured to bias said locking pin toward said guide plate; and wherein said guide plate opening positioned so that said locking pin engages said guide plate opening when said shaft is in said first position.

6. The handle assembly for a network protector of claim 5, wherein said guide plate includes a first position opening and a second position opening.

7. A network protector comprising:

a housing assembly having a sidewall with an opening;

a circuit breaker having a first open position and a second closed position;

said circuit breaker further including a trip bar structured to move between a first position and a second position corresponding to said open and closed position of said circuit breaker, respectively;

a handle assembly comprising:

a shaft assembly, said shaft assembly having a shaft, said shaft rotatably disposed in said opening and structured to move between a first and second position;

a handle member having an elongated body and an elongated grip extending generally perpendicular to said handle body, said handle body coupled to, and structured to rotate, said shaft;

a locking assembly having an elongated release grip, said locking assembly coupled to said handle member and structured to selectively lock said shaft in at least said first position, and said release grip structured to unlock said locking assembly;

said release grip extending generally adjacent and parallel to said handle grip; and a linkage assembly coupled to said shaft and structured to engage said trip bar so that when said shaft is in said first position, said trip bar is in said first position and when said shaft is in said second position, said trip bar is in said second position.

8. The network protector of claim 7, wherein:

said handle grip has a length between about 2 and 5 inches; and said release grip has a length between about 2 and 4 inches.

9. The network protector of claim 8, wherein:

said handle grip has a length of about 3 inches; and said release grip has a length of about 2.5 inches.

10. The network protector of claim 7, wherein said locking assembly is further structured to lock said shaft in said second position.

11. The network protector of claim 7, wherein said locking assembly includes a lever member assembly and a guide plate;

said lever member assembly having an elongated lever member with a pivot pin, a locking pin, a spring and further including said release grip;

said handle member body having an elongated cavity therein;

said lever member disposed in said cavity and coupled to said handle member;

said guide plate having at least one opening and said guide plate coupled to, and extending generally parallel to, said housing assembly sidewall;

said locking pin coupled to, and extending generally perpendicular to, said lever member, said locking pin extending toward said guide plate;

said spring structured to bias said locking pin toward said guide plate; and wherein said guide plate opening positioned so that said locking pin engages said guide plate opening when said shaft is in said first position.

12. The network protector of claim 11, wherein said guide plate includes a first position opening and a second position opening.

* * * * *